United States Patent [19]

Kobayashi

[11] Patent Number: 4,786,766

[45] Date of Patent: Nov. 22, 1988

[54] KEYBOARD APPARATUS

[75] Inventor: Akihiko Kobayashi, Mitaka, Japan

[73] Assignee: Canon Kabushiki Kaisha, Tokyo, Japan

[21] Appl. No.: 147,016

[22] Filed: Jan. 15, 1988

Related U.S. Application Data

[63] Continuation of Ser. No. 73,882, Jul. 16, 1987, abandoned, which is a continuation of Ser. No. 890,541, Jul. 30, 1986, abandoned.

[30] Foreign Application Priority Data

| | | | |
|---|---|---|---|
| Aug. 26, 1985 | [JP] | Japan | 60-185825 |
| Feb. 14, 1986 | [JP] | Japan | 61-028863 |
| Feb. 14, 1986 | [JP] | Japan | 61-028864 |

[51] Int. Cl.[4] ..... H01H 13/70

[52] U.S. Cl. ..... 200/5 A; 200/159 B; 200/340

[58] Field of Search ..... 200/5 R, 5 A, 16 A, 200/183 N, 159 B, 302.2, 314, 328, 340

[56] References Cited

U.S. PATENT DOCUMENTS

| | | | |
|---|---|---|---|
| 3,728,652 | 4/1973 | Nishikawa | 335/207 |
| 3,917,917 | 11/1975 | Murata | 200/83 N X |
| 4,056,701 | 11/1977 | Weber | 200/314 |
| 4,181,826 | 1/1980 | Latasiewicz | 200/340 |
| 4,493,959 | 1/1985 | Viebrantz | 200/340 |

*Primary Examiner*—J. R. Scott

*Attorney, Agent, or Firm*—Fitzpatrick, Cella, Harper & Scinto

[57] ABSTRACT

The first example of a keyboard apparatus of the invention intends to prevent the inclination and shake of a key button by forming retaining claws so as to project downwardly at locations near the corners of the quadrangular key button. The second example intends to prevent to shake of a small-sized key button by arranging the retaining claws formed for the small key button on a diagonal line of the key button, thereby elongating the distance between the retaining claws. The third example intends to automatically adjust the center of the position of the key button by forming the portion to restrict the top dead point of a key button so as to have almost a complementary zigzag shape.

21 Claims, 10 Drawing Sheets

KEYBOARD APPARATUS

This application is a continuation of application Ser. No. 073,882, filed July 16, 1987, now abandoned, which was a continuation of application Ser. No. 890,541, filed July 30, 1986, now abandoned.

BACKGROUND OF THE INVENTION

1. Field of the Invention

The present invention relates to a keyboard apparatus which can prevent unstable factors such as gradient, shake, rotation, and the like of quadrangular key buttons.

2. Related background art

A conventional keyboard apparatus is shown in FIGS. 1 to 23. First, a first conventional structure will be described with reference to FIGS. 1 to 7.

FIGS. 1 and 2 show an electronic desk calculator (hereinafter, abbreviated as an electronic calculator) as an example of an electronic equipment in which a keyboard apparatus is used.

An electronic calculator 101 has an upper casing 102 and a lower casing 103. The front half portion of the upper surface of the upper casing 102 (panel) serves as a keyboard section 104. The keyboard section 104 consists of a number of key buttons 105. A solar battery 106 and a display device 107 are also provided.

As shown in FIG. 1, a keyboard such as keyboard section 104 is filled with a number of key buttons 105 is called a full keyboard type keyboard.

As well as such a full keyboard type keyboard, there is also a keyboard of the type having a plurality of key buttons as shown in FIG. 2. In many cases, the keyboard as shown in FIG. 2 has a structure such that the respective key buttons are inserted from the upper side of the upper casing 102.

In the case of such a structure, the key buttons need to freely descend and ascend and at the same time, a slip-out preventing structure of the key button is also necessary.

FIGS. 3 to 5 show the first example of the key buttons provided with such a slip-out preventing mechanism.

Namely, the key button 105 is formed like A square plate. a prismatic guide axis 108 is projected from the lower surface of the key button 105. The guide axis 108 is slidably inserted into an opening portion 109 formed in the bottom surface of a recess portion 110 adapted to accommodate the key button of the upper casing 102.

On the other hand, retaining claws 111 and 112 are projected from the bottom surface of the key button 105 at the end portions substantially along a diagonal of the key button. Hooks 111*a* and 112*a* are outwardly projected from the lower end portions of the retaining claws 111 and 112.

The claws 111 and 112 are elastically deformed and inserted into guide holes 113 formed in the bottom surface of the recess portion 110 as so to sandwich the opening portion 109.

When the hooks 111*a* and 112*a* pass through the guide holes 113, the upper surfaces of those hooks are retained by notched portions 102*a* formed on the side of the lower surface of the upper casing 102 as shown in FIGS. 4 and 5, respectively.

A printed circuit board 114 is arranged on the side of the bottom surface of the upper casing 102 as shown in FIGS. 4 and 5. A key pattern 115 is formed on the printed circuit board 114 so as to face the guide axis 108.

An elastic rubber plate 116 is disposed on the board 114. The rubber plate 116 is formed with an expanded portion 116*a* having a trapezoidal cross section in correspondence to the guide axis 108. A conductive rubber 117 is fixed to the lower surface of the expanded portion 116*a*.

In the keyboard apparatus having the structure mentioned above, when none of the key buttons 105 is pressed, each key button 105 is upwardly pressed due to the elastic force of the expanded portion 116*a* so that the conductive rubber 117 is apart from the key pattern 115.

On the contrary, when the key button 105 is pressed, the expanded portion 116*a* is elastically deformed, so that the conductive rubber 117 comes into contact with the key pattern 115 and a key signal can be input.

When using the above-mentioned keyboard structure, for instance, in order to smoothly descend and ascend along the guide axis 108, clearance is required between the opening portion 109 and the peripheral surface of the guide axis 106.

When such a key button 105 is pressed, if it is pressed at either one of the positions corresponding to the retaining claws 111 and 112 as indicated at reference numerals 111*b* and 112*b* in FIG. 3, a slight force f will be applied to this position as shown in FIG. 6. However, in this case, an amount of inclination of the key button 105 will be small since the retaining claws 111 and 112 also serve as guide members. On the contrary, as shown at reference characters X and Y in FIG. 3, if the force f is applied to either one of the positions where the retaining claws 111 and 112 are not formed, the opposite side on the diagonal line will be greatly lifted up.

Thus, as shown in FIG. 7, there is the drawback such that the key button 105 is greatly inclined and shaken.

A second conventional structure will now be described with reference to FIGS. 8 to 14.

FIGS. 8 to 10 show a second example of key buttons equipped with a slip-out preventing mechanism as a modified form of FIGS. 3 to 5 mentioned above.

Namely, a key button 205 is formed like a square plate. A prismatic guide axis 208 is projected from the lower surface of the key button 205. The guide axis 208 is slidably inserted into an opening portion 209 formed in the bottom surface of a recess portion 210 adapted to accommodate the key button of the upper casing 202.

In addition, retaining claws 211 and 212 project from the bottom surface of the key button 205 at the edge portions substantially along a diagonal of the key button. Hooks 211*a* and 212*a* outwardly project from the lower end portions of the retaining claws 211 and 212.

The claws 211 and 212 are elastically deformed and inserted into guide holes 213 formed in the bottom surface of the recess portion 210 so as to sandwich the opening portion 209.

When the hooks 211*a* and 212*a* pass through the guide holes 213, the upper surfaces of the hooks are retained by notched portions 202*a* formed on the side of the lower surface of the upper casing 202 (panel) as shown in FIGS. 9 and 10, respectively.

A printed circuit board 214 is arranged on the side of the bottom surface of the upper casing 202 as shown in FIGS. 9 and 10.A key pattern 215 is formed on the printed circuit board 214 so as to face the guide axis 208.

On the other hand, an elastic rubber plate 216 is disposed over the board 214. The rubber plate 216 is formed with an expanded portion 216*a* having a trapezoidal cross section in correspondence to the guide axis 208. A conductive rubber 217 is fixed to the lower surface of the expanded portion 216*a*.

In the keyboard apparatus having the structure mentioned above, when none of the key buttons 205 is pressed, each key button 205 is upwardly pressed due to the elastic force of the expanded portion 216*a* , so that the conductive rubber 27 is away from the key pattern 215.

On the contrary, when the key button 205 is pressed, the expanded portion 216*a* is elastically deformed, so that the conductive rubber 217 comes into contact with the key pattern 215 and a key signal can be input.

When using the above-mentioned keyboard structure, for instance, in order to smoothly descend and ascend along the guide axis 208, a clearance is required between the opening portion 209 and the peripheral surface of the guide axis 206.

Therefore, if a slight force f is applied to one end of the key button 205 as shown in FIG. 11, a rotational motion will occur in the key button 205 around the contact portion between the upper surface of the notched portion 202*a* and one end 212*b* of the hook 212*a* as a rotational center.

Thus, when the right end of the key button 205 descends by a distance $\alpha$, the left end is contrarily lifted up by only a distance $\beta$ as shown in FIG. 11.

In the case shown in FIG. 11, there is the relation of $\alpha > \beta$ since the hook 212*a* is located at nearly the intermediate position between the guide axis 208 and the edge of the key button 205.

On the other hand, when the hook 212*a* is located near the side of the guide axis 208 as shown in FIG. 12, when the right end side of the key button descends by only the distance $\alpha$, the left end is lifted up by a distance $\gamma$, so that there is the relation of $\gamma > \beta$.

In such a case, the key button will also greatly shake.

Therefore, to prevent such a shake, there has been proposed the structure in which the hook 212*a* is formed at the maximum distance away from the guide axis 208 as shown in FIGS. 13 and 14.

When such a structure is used, even if the force f is applied to the right end side of the key button and this side accordingly descends by a distance $\alpha$ as shown in FIG. 13, the portion at a left end A won't be lifted up, so that the shaking motion of the key button will be reduced.

However, electronic equipment provided with the keyboard has been more and more miniaturized and both the keyboard and the key buttons have also been miniaturized in association with it. Thus, even if the hook portion is formed at the maximum distance away from the guide axis, the effect to reduce the shaking motion of the key button will be small.

There is also the drawback such that an increase in size of the button obstructs the miniaturization of the whole keyboard apparatus.

The third conventional structure will now be described with reference to FIGS. 15 to 23.

Such a conventional apparatus has the structure such that a part (e.g., 301*a* in FIG. 15) of the outer periphery of the key button, an outer peripheral surface (e.g., 307*a* in FIG. 17) of the axial portion formed integrally with the key button, or an outer peripheral surface (e.g., FIG. 21) of a slide part of a key button unit integrally formed from a plurality of members can slide with a part of an inner peripheral surface of an opening portion of a supporting member (a part of a casing is commonly used as this supporting member) which faces this outer peripheral slide surface. The position in the lateral direction in the opening portion of the supporting member of the key button is controlled due to each of those slide surfaces.

FIGS. 15 to 23 illustrate different practical conventional examples, respectively.

In the example shown in FIGS. 15 and 16, each side surface of a key button 301 serves as the slide surface 301*a* adapted to be slidable between the key button 301 and the supporting member. A flange 301*b*, also serving as a stopper to determine the top dead point of the key button, is formed on the lower end of the key button 301.

A supporting member (panel) 302 is provided as part of the casing. An inner surface of an opening portion into which the key button 301 is inserted functions as a sliding surface 302*a* of the key button. A surface 302*b* on the lower side of the peripheral surface of the opening portion is the surface to determine the top dead point of the key button.

An elastic member 303 consisting of flexible rubber or the like is arranged under the key button, thereby lifting up the key button. A conductive member 303*a* is integrally formed on the lower surface of the head portion of the elastic member 303.

A key pattern 305 is formed on a base plate 304.

In the above structure, the sliding clearance of dimension "a" is required between the slide surface 301*a* of the key button and the sliding surface 302*a* of the supporting member.

FIGS. 17 to 19 show another conventional example of a unit structure. Reference numeral 306 denotes a key button and 307 indicates a slide part pressure inserted into the key button 306. The side surface of the slide part 307 serves as the slide surface 307*a*.

As shown in the enlargement in FIG. 18, a projecting portion 307*b* having a right-angled triangular cross section is formed in the lower end portion on the outside of the slide surface 307*a*. The upper surface of the projecting portion 307*b* functions as an abutting surface of the portion to determine the top point of the slide part 307 against the supporting member.

Numeral 308 denotes a supporting member, 308*a* is a slide surface of the supporting member 308, and 308*b* is a supporting member surface to decide the top dead point of the slide part 307.

In addition, numeral 309 denotes a spring to lift up the key button unit and make the lower flexible base plate operative; 310 is a flexible base plate having a pattern 314 on the back side surface; 311 is a flexible base plate having a pattern 315 on the front side surface; 312 is a spacer interposed between the flexible base plates 310 and 311; 313 is a reinforcing plate to support the flexible base plates; and 314 and 315 are the key patterns.

When using the above-mentioned structure, a clearance "b" which provides a vertical slide motion is required between the slide surface 307*a* of the slide part of the key button unit and the slide surface 308*a* of the supporting member.

In the example shown in FIGS. 20 and 21, numeral 316 denotes a key button; 316*a* is a key button slide surface; and 317 is a side wall formed integrally with the key button 316 and serving as a slide surface. The outside of the lower end of the side wall 317 is formed with a projection 317*a* which determines the top dead point of the key button.

Numeral 318 denotes a supporting member and a cylindrical body 318*a* adapted to guide the slide surface 316*a* is formed as part of the supporting member 318. The inner peripheral surface of the supporting member 318 functions as a slide surface.

Numeral 318*b* denotes a supporting member surface to determine the top dead point of the key button 316; 319 is a flexible rubber to lift up the key button; 320 is a conductive member formed integrally with the flexible rubber 319; 321 is a base plate; and 322 is a key pattern section formed on the base plate 321.

When such a structure is used, a clearance of a dimension "c" is necessarily formed between the slide surface 316*a* of the key button and the slide surface 318*a* of the supporting member.

As described in the foregoing three conventional examples, a clearance is necessarily required between the slide surface of the key button and the slide surface of the supporting member and a shaking motion occurs due to this clearance in the conventional examples.

Thus, inclination, rotation, or eccentricity of a key button as shown in FIGS. 22 and 23 inevitably occurs. Therefore, there is the large drawback from the viewpoints of external appearance and quality.

SUMMARY OF THE INVENTION

It is the first object of the present invention to prevent the inclination and shake of the key button.

A second object of the invention is to provide a small-size key button in which rotation and shake are less likely to occur.

A third object of the invention is to automatically adjust the central position of a key button at the top dead point of the key button.

BRIEF DESCRIPTION OF THE DRAWINGS

FIGS. 1 and 2 are perspective views of an electronic calculator;

FIG. 3 is an exploded perspective view of the main part;

FIG. 4 is a cross sectional view taken along the line 4—4 in FIG. 3;

FIG. 5 is a cross sectional view taken along the line 5—5 in FIG. 3; and FIGS. 6 and 7 are explanatory diagrams for explaining a shaking state.

Figure 8:
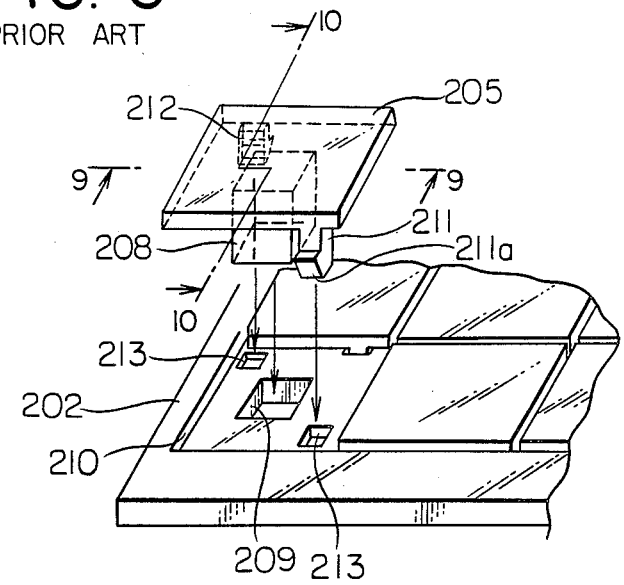
FIG. 8 PRIOR ART
Figure 9:
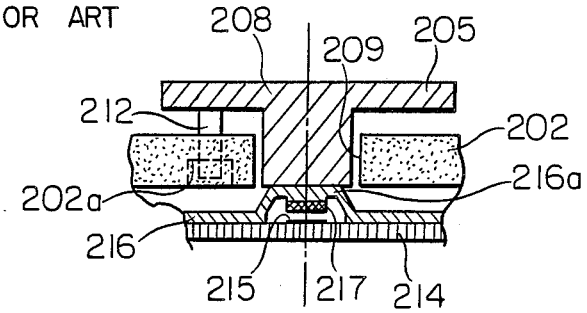
FIG. 9 PRIOR ART
Figure 10:
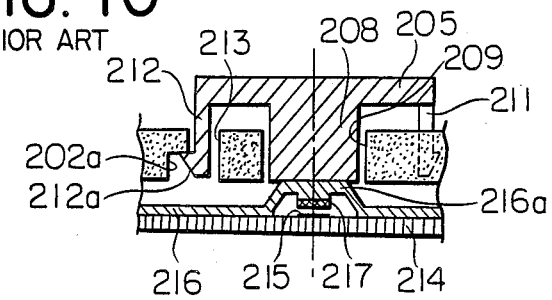
FIG. 10 PRIOR ART
Figure 11:
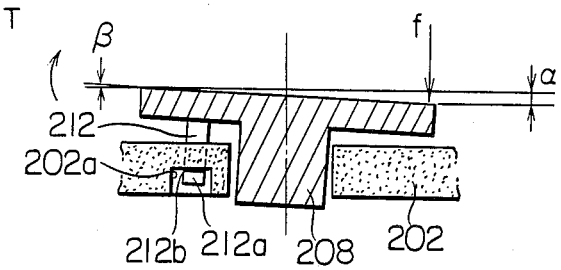
FIG. 11 PRIOR ART
Figure 12:
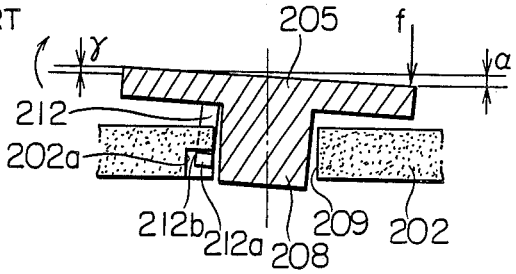
FIG. 12 PRIOR ART
Figure 13:
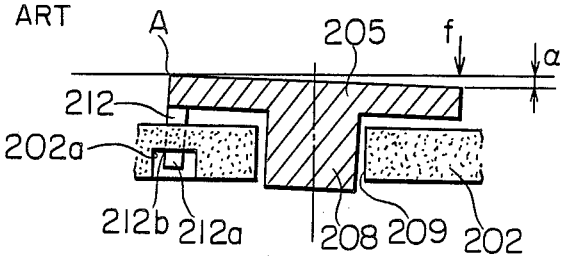
FIG. 13 PRIOR ART
Figure 14:
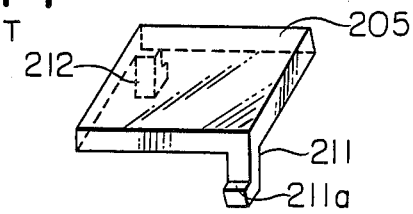
FIG. 14 PRIOR ART

In the second conventional structure;

FIG. 8 is an exploded perspective view of the main part;

FIG. 9 is a cross sectional view taken along the line 9—9 in FIG. 8;

FIG. 10 is a cross sectional view taken along the line 10—10 in FIG. 8;

FIGS. 11 to 13 are explanatory diagrams for explaining the position of a retaining claw and a shaking state of a key button; and FIG. 14 is a perspective view of the key button.

Figure 15:
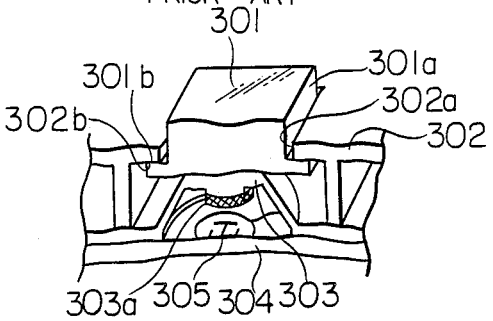
FIG. 15 PRIOR ART
Figure 16:
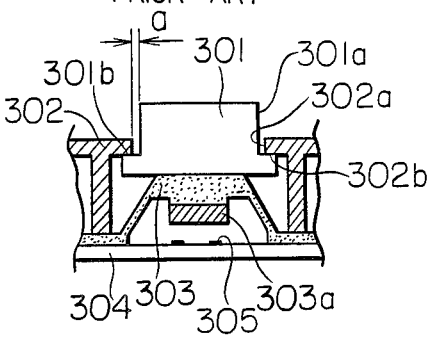
FIG. 16 PRIOR ART
Figure 17:
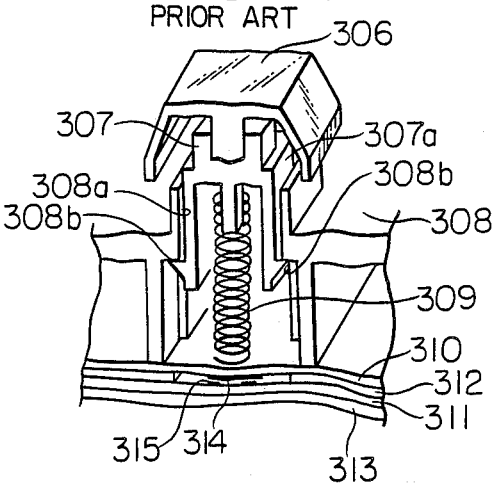
FIG. 17 PRIOR ART
Figure 18:
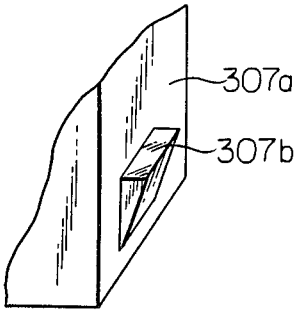
FIG. 18 PRIOR ART
Figure 19:
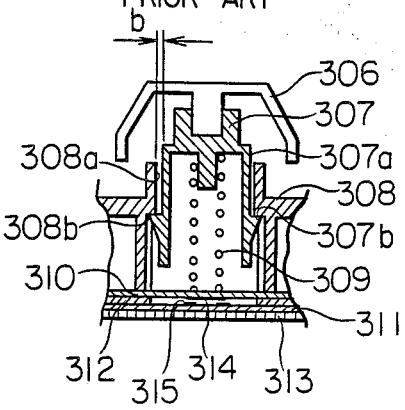
FIG. 19 PRIOR ART
Figure 20:
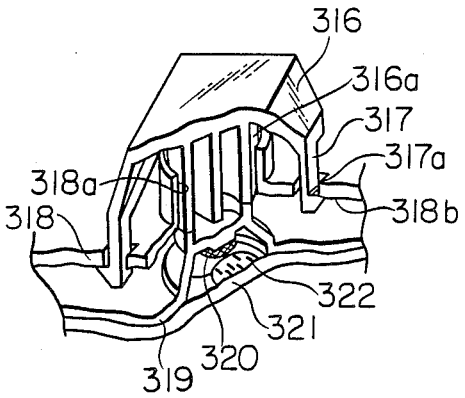
FIG. 20 PRIOR ART
Figure 21:
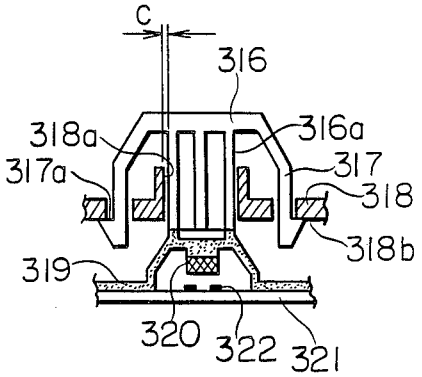
FIG. 21 PRIOR ART
Figure 22:
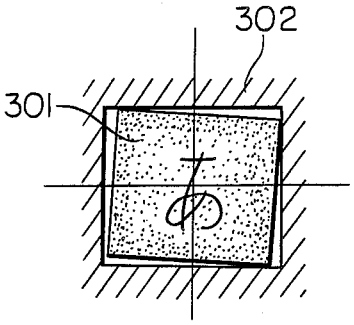
FIG. 22 PRIOR ART
Figure 23:
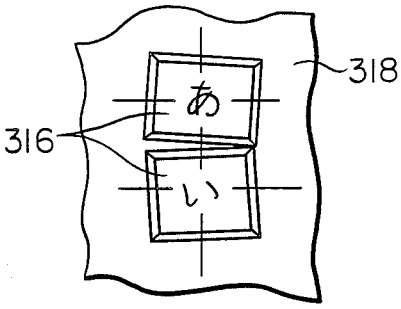
FIG. 23 PRIOR ART

Further, in the third conventional structure:

FIGS. 15 and 16 are views perspective view of a key top portion with a part cut away and a cross sectional view of a state in which the key top portion is actually installed for explaining the third example of the conventional structure;

FIGS. 17 to 19 are diagrams for explaining another example of the conventional structure;

FIG. 17 is a perspective view of a key button portion with a part cut away;

FIG. 18 is a perspective view of an engaging portion of a key button;

FIG. 19 is a cross sectional view showing an installed state;

FIGS. 20 and 21 are perspective views of a key button portion with a part cut away and a cross sectional view of an installed state for explaining further another conventional embodiment; and FIGS. 22 and 23 are explanatory diagrams for explaining conventional drawbacks.

Figure 24:
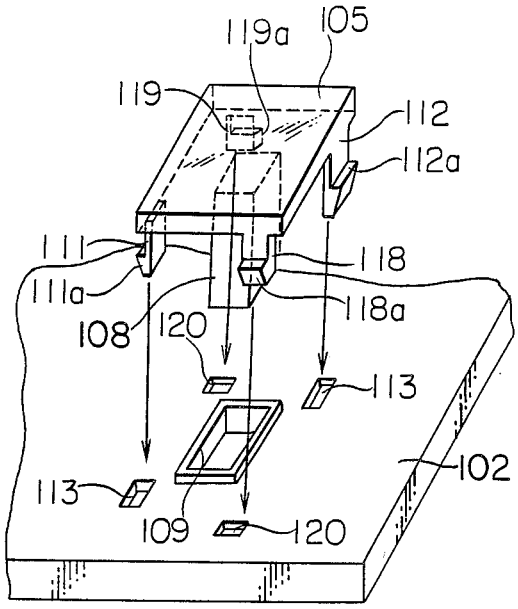
Figure 25:
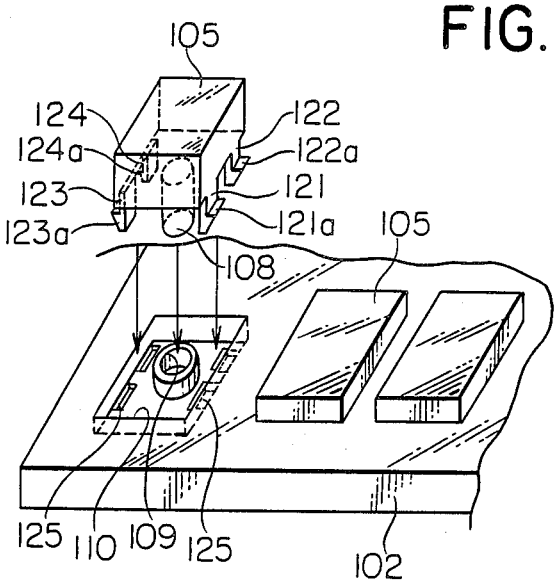
Figure 26:
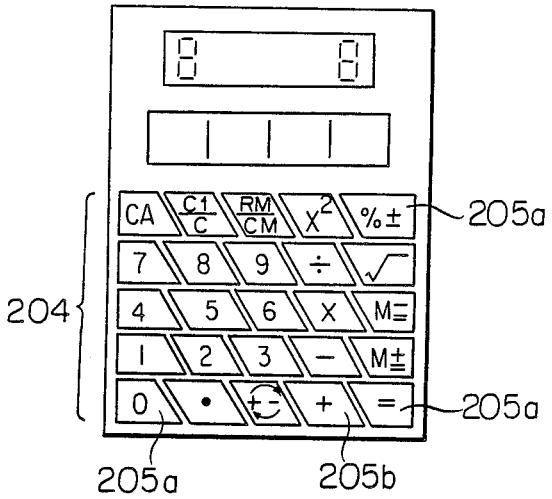
Figure 27A:
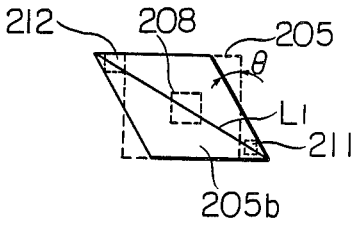
Figure 27B:
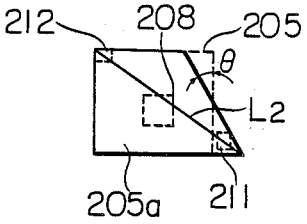
Figure 28:
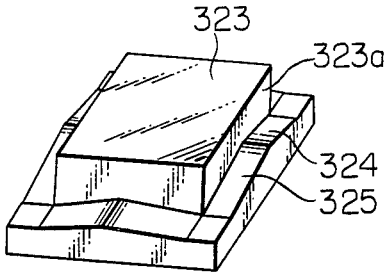
Figure 29:
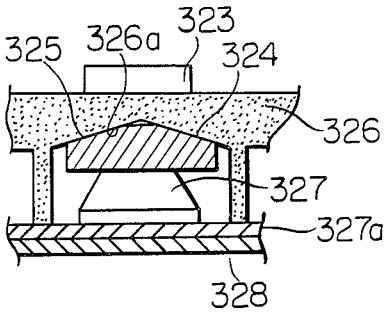
Figure 30:
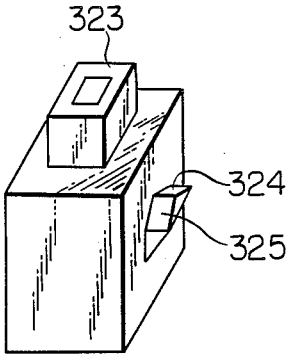
Figure 31:
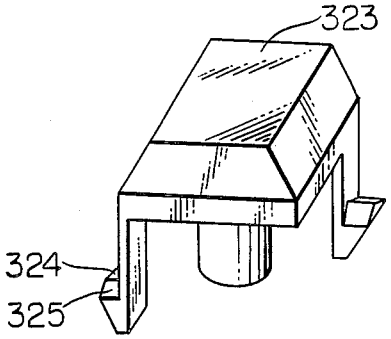
Figure 32:
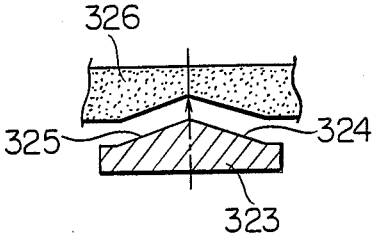
Figure 33:
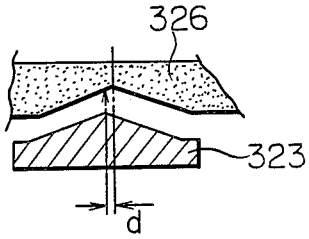
Figure 34:
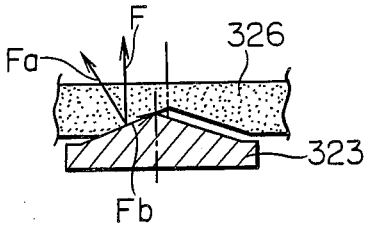

Next, FIGS. 24 to 34 show structures according to the present invention, in which:

FIGS. 24 and 25 are explained perspective views of the main parts for explaining the first and second embodiments of the present invention;

FIGS. 26, 27 A and 27B are diagrams for explaining the third embodiment of the invention;

FIG. 26 is a plan view of an electronic calculator;

FIGS. 27A and 27B are plan views of a key button;

FIG. 28 is a perspective view of a key button; FIG. 29 is a cross sectional view of a composite switch assembly of an installed for explaining the fourth embodiment of the invention;

FIGS. 30 and 31 are perspective views of key buttons for explaining the fifth and sixth embodiments of the invention, respectively; and FIGS. 32 to 34 are cross sectional views for explaining the key button operation.

DETAILED DESCRIPTION OF THE PREFERRED EMBODIMENTS

The first and second embodiments according to the present invention use the structure such that retaining claws are formed near the respective corners of each of a number of key buttons in order to solve the problems in the first conventional structure mentioned above.

With such a structure, the retaining claws respectively provided near the corners of each quadrangular key button function as guide members. Thus, even if any portion on the upper surface of the key button is pressed as well, the key button will be depressed without shaking.

The invention will now be described in detail hereinbelow with respect to the embodiments shown in the diagrams.

FIG. 24 is a diagram for explaining the first embodiment of the invention, in which the same or corresponding parts and components as those shown in FIGS. 1 to 7 are designated by the same reference numerals and their descriptions are omitted.

Figure 1:
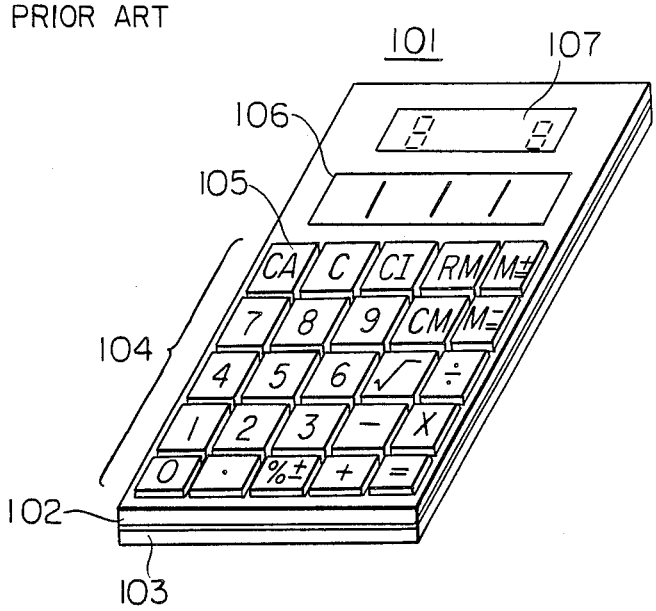
FIG. 1 PRIOR ART
FIGS. 1 to 7, 8 to 14, and 15 to 23 show the first, second, and third conventional structures, respectively. First, in the conventional structure.
Figure 2:
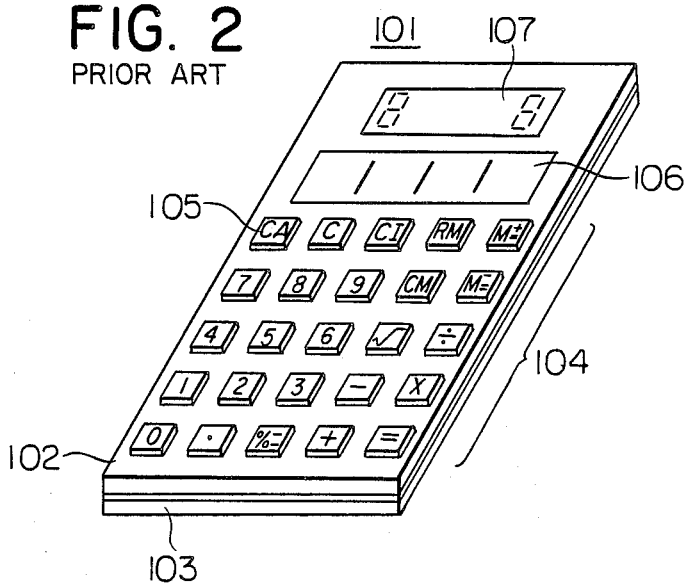
FIG. 2 PRIOR ART
Figure 3:
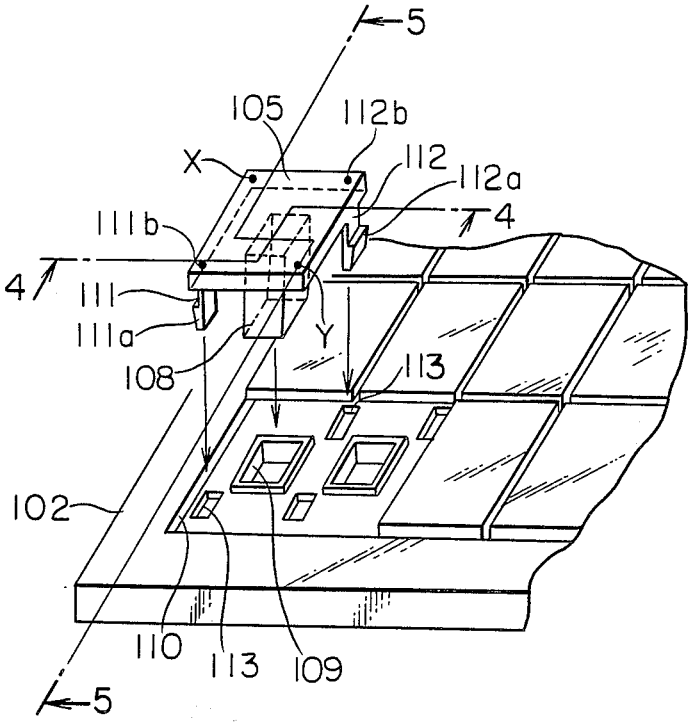
FIG. 3 PRIOR ART
Figure 4:
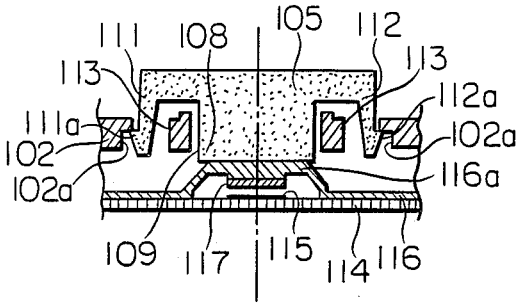
FIG. 4 PRIOR ART
Figure 5:
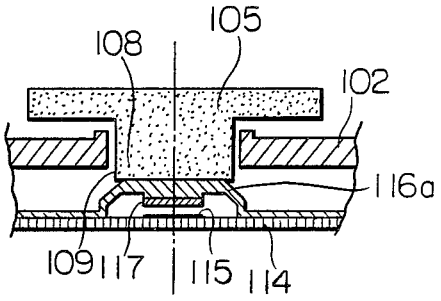
FIG. 5 PRIOR ART
Figure 6:
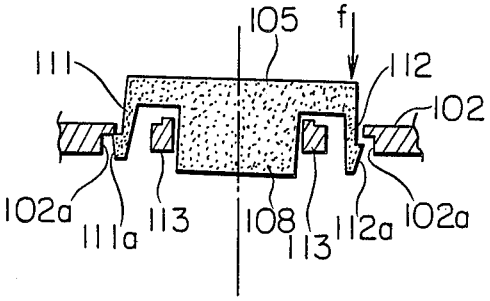
FIG. 6 PRIOR ART
Figure 7:
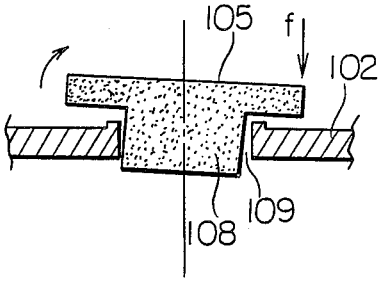
FIG. 7 PRIOR ART

In this embodiment, retaining claws 118 and 119 are also projected at the corners indicated at reference characters X and Y of the key button 105 shown in FIG. 3.

Therefore, the key button 105 has four retaining claws 111, 112, 118 and 119.

The claws 118 and 119 are also formed with hooks 118*a* and 119*a*, respectively.

In addition to the guide holes 113 adapted to receive the retaining claws 111 and 112, guide holes 120 into which the retaining claws 118 and 119 can be inserted are formed in the upper casing 102.

In the embodiment shown in FIG. 24, the hook of each of those retaining claws outwardly projected from each side of the quadrangular key button 105.

In this embodiment, since the retaining claws are respectively formed at the corners of the key button as mentioned above, these claws serve as guide members. Therefore, even if any position of the upper surface of the key button 105 is pressed, the key button can descend and ascend without greatly inclining or shaking.

FIG. 25 is a diagram for explaining the second embodiment of the invention. In this embodiment, a pair of retaining claws 121 and 122 and another pair of retaining claws 123 and 124 are formed along the right and left sides of and near the corners of the key button 105, respectively.

The respective retaining claws are formed with corresponding hooks 121*a* to 124*a* so as to face outside. Guide holes 125 into which the retaining claws are respectively inserted are formed in the recess portion 110 of the upper casing 102.

When the foregoing structure is used as well, each retaining claw functions as a guide member, so that the key button 105 will not shake.

As will be obviously understood from the above description, according to the first and second embodiments of the invention, a structure is used such that the retaining claw is formed near each corner of the key button having a quadrangular shape. Thus, these retaining claws serve as guide members when the key button descends and ascends, thereby preventing the key button from inclining and shaking.

Next, to solve the problem in the second conventional structure mentioned above, the third embodiment of the invention uses the following structure. Namely, among a number of key buttons arranged adjacently, excluding the key buttons locating at both of the right and left end portions, each of the other key buttons is formed like a parallelogram and at the same time, retaining claws are projected from the lower surface of the corners in the direction of a long diagonal line of each key button.

By use of the above-mentioned structure, a length of one diagonal line of the key button can be set to be long. By providing the retaining claws at both ends in the direction of this diagonal line, the distance between the retaining claw and the guide axis can be increased. This is equivalent to a substantial enlargement of the key button, so that the shake of the key button can be remarkably reduced.

The invention will now be described in detail hereinbelow with reference to other embodiments shown in the drawings.

FIGS. 26, 27A, and 27B are diagrams for explaining the third embodiment of the present invention, in which the same or corresponding parts and components as those shown in FIGS. 8 to 14 are designated by the same reference numerals and their descriptions are omitted.

In this embodiment, key buttons constituting a keyboard section 204 are classified into key buttons 205*a* locating at both right and left ends and key buttons 205*b* locating at the central portion. Each key button 205*b* located at the central portion is formed in the shape of a parallelogram. Each of the key buttons 205*a* located at the right and left ends has a trapezoidal shape.

By use of the above-mentioned structure, as indicated at reference characters $L_1$ and $L_2$ in FIGS. 27A and 27B, a length of one diagonal line can be set to be fairly longer than that of the conventional key button 205.

Therefore, by providing the retaining claws 211 and 212 at the positions corresponding to both ends of each of the long diagonal lines $L_1$ and $L_2$, each retaining claw can be arranged at the maximum distance away from the guide axis 208.

Therefore, the shake of key button is remarkably reduced.

In addition, as will be obvious from FIG. 26 as well, even if the shape of key button is deformed, the whole area of the keyboard section 204 won't change, so that the miniaturization of the electronic equipment of electronic calculators and the like will not be obstructed.

As will be apparent from the above description, according to this embodiment, among the key buttons constituting the keyboard, each of the key buttons locating at both right and left ends has almost a trapezoidal shape and each of the key buttons locating between both ends has the shape of a parallelogram. Thus, the retaining claws can be formed at the positions corresponding to both ends of a long diagonal line of each of these key buttons. The distance between the retaining claws can be elongated. The distance between the retaining claw and the guide axis can be also elongated. The shake of key button can be eliminated. The miniaturization of electronic equipment is not be obstructed.

Further, to solve the prblems in the third conventional structure mentioned above, the fourth to sixth embodiments of the invention use a structure such that the engaging portion which determines the top dead point of the key button is formed in a zigzag shape having substantially complementary structure at a plurality of positions between the key button and the supporting member.

By use of the above-mentioned structure, when the convex (or mountain-like) and concave (or valley-like) portions having mutually nearly complementary shapes come into engagement with each other, an automatic center adjusting force which horizontally moves the key button due to the horizontal component of force is provided, so that the key button is positively reoriented at an accurate location at its top dead point so as to have the proper position.

The fourth embodiment of the invention will now be described with reference to FIGS. 28 and 29. In the diagrams, numeral 323 denotes a key button. Each side surface of the key button serves as a slide surface 323*a* with the supporting member of the key button. By providing inclined surfaces 324 and 325 for the engaging surfaces of the key button with the supporting member, a convex portion which protrudes upwardly is formed at a total of four locations.

FIG. 29 is a cross sectional view of a key button similar to that depicted in FIG. 28 and shows an installed state of key buttons. In FIG. 29, numeral 326 denotes a supporting member; 327 and 327*a* are flexible portions formed of rubber or the like; and 328 is a base plate. Flexible portions 327 and 327*a* include a pair of conductive members which contact each other and transmit a key depression signal when key button 323 is depressed. The engaging portion of the supporting member 326 with the key button is formed with a recess portion 326*a* like a valley having a shape which is complementary to the convex portion on the key button side.

By use of such a structure, the position of the top dead point of the key button is not determined by the slide surface 323*a* of the key button and the slide surface of the supporting member adapted to contact it, but is determined by the positional relation between the mountain-like portion and the valley-like recess portion 326*a* consisting of the inclined surfaces 324 and 325 of the key button.

Numerals 324 and 325 denote the V-shaped surfaces of the key button flange portion or click portion (portion to determine the top dead point), and 326 indicates the supporting member.

Since there is a clearance between the slide surfaces of the key button 323 and the supporting member 326, with respect to the position of the key button at the bottom dead point, the center of the convex portion of the key button as shown in FIG. 32 rarely coincides with the center of the valley-like recess portion 326*a* of the supporting member. A central difference of dimension "d" occurs as shown in FIG. 33. In a state as shown in FIG. 34, the key button 323 abuts on the supporting member and thereafter the key button moves to the state as shown in FIG. 29.

At this time, the whole return force F of the key button 323 is not applied to the valley-shaped recess portion 326*a* of the supporting member 326 as shown in FIG. 34, but a vertical component Fa of the force F functions as an abutting force on the supporting member 326 and a horizontal component Fb of the force F serves an acting force to move the key button to the center and becomes a factor of the component of force to abut on the inclined surface on the opposite side. Thus, the automatic center adjusting function occurs.

In the conventional structure, the return force F of the key button causes an annoying hitting sound. On the other hand, according to the invention, $Fa<F$ is expressed as a hitting sound due to the vertical component Fa of force and at the same time, the horizontal component Fb of force abuts on the inclined surface on the opposite side as a reduced force lower than the value of Fb due to the friction upon movement of the key button to the center. Thus, the hitting sound can be reduced due to the distribution of the force and the decrease in the friction.

In addition, in the above description, the mountain portion having the convex shape has been formed on the key button side and the valley portion having the concave shape has been provided on the supporting member side. However, in the case where the concave valley portion is provided on the key button side and the mountain portion of the convex shape is provided on the supporting member side, a similar effect can be obtained. Also, a similar effect will be obtained even due to a combination of various kinds of zigzag shapes other than the V-shape.

Further, in the fourth embodiment mentioned above, the mountain portion has been provided in the flange portion of the key button 323. However, as in the fifth and sixth embodiments shown in FIGS. 30 and 31, respectively, the inclined surfaces 324 and 325 may be also provided in the projecting portions other than the flange portion of the key button and the supporting member may be also complementarily formed with valley-shaped concave portions at the positions adapted to come into engagement with these mountain portions.

As will be apparent from the above description, according to the present invention, the key button and the engaging portion of the supporting member are formed in a zigzag shape having a complementary relationship. Therefore, automatic center adjustment due to the zigzag portion is performed when the key button ascends and the key button can be positively reoriented at a predetermined location so as to have an accurate position. At the same time, hitting sound generated when the key button reaches the top dead point can be remarkably reduced.

I claim:

1. A keyboard apparatus comprising:

panel means having a single first opening portion and four second opening portions;

input means adjacent a first side of said panel means comprising a pair of conductive members separated by an elastic force and adapted to contact each other due to a pressing force; and a key button substantially in the shape of a quadrangle arranged adjacent a second side of said panel means, said button comprising a first projecting portion which projects from substantially the center of said key button and four second projecting portions each having an engaging member and each projecting from near one of four corners of said key button, wherein said first projecting portion is inserted through said first opening portion and thereby guided in a predetermined direction by said first opening portion to said first side of said panel means, the end portion of said first projecting portion contacting said input means so as to be biased away from said panel means by the elastic power of said input means, and wherein each of said four second projecting portions is inserted through different ones of said second opening portions to said first side of said panel means, each engaging member of said second projecting portions engaging near to said different one of said second opening portions so as to provide a force against the elastic power of said input means.

2. A keyboard apparatus according to claim 1, wherein each of said engaging members comprises a hook to stop the movement of the key button by abutting on said first side of said panel means.

3. A keyboard apparatus according to claim 1 or 2, wherein each of said second projecting portions is formed on a different side of said key button.

4. A keyboard apparatus according to claim 1 or 2, wherein a pair of said second projecting portions is formed on a single side of said key button.

5. A keyboard apparatus comprising:

panel means having a single first opening portion and two second opening portions;

input means adjacent a first side of said panel means comprising a pair of conductive members separated by an elastic force and adapted to contact each other due to a pressing force; and a key button substantially in the shape of either of a parallelogram and a trapezoid having at least a single acute angle and a single obtuse angle, arranged adjacent a second side of said panel means, said key button comprising a first projecting portion which projects from substantially the center of said key button and two second projecting portions each having an engaging member and each projecting from near one of two corners on the longer one of two diagonal lines of said key button, wherein said first projecting portion is inserted through said first opening portion and thereby guided in a predetermined direction by said first opening portion to said first side of said panel means, the end portion of said first projecting portion contacting said input means so as to be biased away from said panel means by the elastic power of said input means, and wherein each of said two second projecting portions is inserted through different ones of said second opening portions to said first side of said panel means, each engaging member of said second projecting portions engaging near to said different one of said second opening portions so as to provide a force against the elastic power of said input means.

6. A keyboard apparatus according to claim 5, wherein each of said engaging members comprises a hook to stop the movement of the key button by abutting on said first side of said panel means.

7. A keyboard apparatus according to claim 6, wherein said hook formed for the key button is formed outwardly from the key button.

8. A keyboard apparatus comprising:

panel means having a plurality of discrete locations, each location having a first opening portion and a plurality of second opening portions;

a plurality of input means adjacent a first side of said panel means, each of said input means comprising a pair of conductive members separated by an elastic force and adapted to contact each other due to a pressing force; and a group of key buttons of a keyboard including a plurality of key buttons substantially in the shape of a quadrangle which are arranged adjacent a second side of said panel means, each of said plurality of key buttons comprising a first projecting portion which projects from substantially the center of said key button and a plurality of second projecting portions projecting from said key button wherein said first projecting portion is inserted through said first opening portion and thereby guided in a predetermined direction by said first opening portion to said first side of said panel means, the end portion of said first projecting portion contacting an associated one of said input means so as to be biased away from said panel means by the elastic power of said input means, and wherein each of said second projecting portions is inserted through said second openings to said first side of said panel means, each engaging member of said second projecting portions engaging near to said second opening portions so as to provide a force against the elastic power of said input means, wherein each of the key buttons locating at one end and the other end of said panel means has a trapezoidal shape, and each of the key buttons arranged at positions sandwiched between said trapezoidal key buttons has a parallelogram shape.

9. A keyboard apparatus according to claim 8, wherein said first projecting portion of said key button depresses said input means through said first opening portion of said panel means, and said engaging members of said second projecting portions of the key button restrict the movement of the key button by abutting on the panel means through said second opening portions of the panel means.

10. A keyboard apparatus according to claim 9, wherein each of said engaging members comprises a hook to stop the key button by abutting on said first side of said panel means.

11. A keyboard apparatus comprising:

panel means having at least a first opening portion and a plurality of second opening portions and a plurality of surfaces inclined in different directions relative to a first side of said panel means and formed at said first side of said panel means near said second opening portions;

input means adjacent said first side of said panel means comprising a pair of conductive members adapted to contact each other due to a pressing force; and a key button substantially in the shape of a quadrangle which is arranged adjacent a second side of said panel means, said key button comprising a first projecting portion and second projecting portions, wherein said first projecting portion projects from substantially the center of the quadrangle to said first side of said panel means so as to be inserted through said first opening portion and to depress said input means, and each of said second projecting portions projects to said first side of said panel means and comprises a plurality of inclined surfaces each complementarily in contact with corresponding one of said surfaces of said panel means, each of said second projecting portions being inserted through different ones of said second opening portions.

12. A keyboard apparatus according to claim 11, wherein said second projecting portions formed for said key button is formed near both ends of a diagonal line of the quadrangular key button.

13. A keyboard apparatus comprising:

panel means having an opening portion and a plurality of surfaces each inclined in different directions relative to a first side of said panel means and formed at said first side of said panel means near said opening portion;

input means adjacent said first side of said panel means comprising a pair of conductive members adapted to contact each other due to a pressing force; and a key button having a pressing portion and a flange portion in which one end of said pressing portion abuts on said input means, the end extending through said opening portion of said panel means, and said flange portion is formed with a plurality of complementary inclined surfaces adapted to contact corresponding ones of said inclined surfaces of said panel means on said first side of said panel means.

14. A keyboard apparatus according to claim 13, wherein each of said complementary inclined surfaces are formed on an upper surface of said flange portion formed for said key button.

15. A keyboard apparatus according to claim 13, wherein each of said complementary inclined surfaces are formed so as to project from a side surface of said flange portion formed for said key button.

16. A keyboard apparatus according to claim 13, wherein said inclined surfaces on said panel means are formed in the shape of one of a convex and a concave and said complementary inclined surfaces of said flange portion are formed in the shape of the other of the convex and the concave.

17. A keyboard apparatus according to claim 11, wherein said inclined surfaces on said panel means are formed in the shape of one of a convex and a concave and said complementary inclined surfaces of said second projecting portion are formed in the shape of the other of said convex and said concave.

18. A keyboard apparatus comprising:

panel means having an opening portion;

input means adjacent a first side of said panel means comprising a pair of conductive members separated by an elastic force and adapted to contact each other due to pressing force; and a key button substantially in the shape of either of a parallelogram or a trapezoid having at least a single acute angle and a single obtuse angle, arranged adjacent at least a second side of said panel means, said key button being inserted through said opening portion to said first side of said panel means, the end portion of said key button contacting said input means so as to be biased away from said first side toward a second side of said panel means by the elastic power of said input means.

19. A keyboard apparatus comprising:

panel means having a plurality of discrete locations, each location having an opening portion;

a plurality of input means adjacent a first side of said panel means, each of said input means comprising a pair of conductive members separated by an elastic force and adapted to contact each other due to a pressing force; and a group of key buttons of a keyboard including a plurality of key buttons substantially in the shape of a quadrangle which are arranged adjacent at least a second side of said panel means, each of said plurality of key buttons being inserted through one of said opening portions to said first side of said panel means, the end portion of said key button contacting said input means so as to be biased away from said first side toward a second side of said panel means by the elastic power of said input means;

wherein each of the key buttons located at one end and the other end of said panel means has a trapezoidal shape, and each of the key buttons arranged at positions sandwiches between said trapezoidal key buttons has a parallelogram shape.

20. A keyboard apparatus according to claim 19, wherein said key button includes a projecting portion for depressing said input means through said opening portion of said panel means.

21. A keyboard apparatus according to claim 18, wherein said keyboard includes a plurality of key buttons substantially in the shape of a parallelogram, said plurality of key buttons being arranged in a matrix.

* * * * *

UNITED STATES PATENT AND TRADEMARK OFFICE

CERTIFICATE OF CORRECTION

PATENT NO. : 4,786,766

DATED : November 22, 1988

INVENTOR(S) : AKIHIKO KOBAYASHI

It is certified that error appears in the above-identified patent and that said Letters Patent is hereby corrected as shown below:

Title page:

AT [75] INVENTOR

"Akihiko Kobayashi, Mitaka, Japan" should read --Akihiko Kobayashi, Tokyo, Japan--.

COLUMN 1

Line 30, "is" (first occurrence) should be deleted.
Line 45, "A" should read --a--.
Line 46, "a" should read --A--.
Line 60, "as so" should read --so as--.

COLUMN 2

Line 65, "10.A" should read --10. A--.

COLUMN 3

Line 9, "conductive rubber 27" should read --conductive rubber 217--.
Line 19, "guide axis 206." should read --guide axis 208.--.
Line 57, "the button" should read --the key button--.
Line 59, "The" should read --A--.

COLUMN 4

Line 35, "pressure inserted" should read --pressure-inserted--.
Line 43, "top point" should read --top dead point--.

UNITED STATES PATENT AND TRADEMARK OFFICE

CERTIFICATE OF CORRECTION

PATENT NO. : 4,786,766

DATED : November 22, 1988

INVENTOR(S) : AKIHIKO KOBAYASHI

It is certified that error appears in the above-identified patent and that said Letters Patent is hereby corrected as shown below:

COLUMN 5

Line 44, "cross sectional" should read --cross-sectional--.
Line 46, "cross sectional" should read --cross-sectional--.
Line 50, "structure;" should read --structure:--.
Line 53, "cross sectional" should read --cross-sectional--.
Line 55, "cross sectional" should read --cross-sectional--.
Line 63, "cross sectional" should read --cross-sectional--.

COLUMN 6

Line 5, "cross sectional" should read --cross-sectional--.
Line 8, "cross sectional" should read --cross-sectional--.
Line 15, "explained" should read --exploded--.
Line 18, "27 A" should read --27A--.
Line 23, "cross sectional" should read --cross-sectional--.
Line 24, "installed for" should read --installed key button for--.
Line 29, "cross sectional" should read --cross-sectional--.
Line 67, "projected" should read --projects--.

UNITED STATES PATENT AND TRADEMARK OFFICE

CERTIFICATE OF CORRECTION

PATENT NO. : 4,786,766

DATED : November 22, 1988

INVENTOR(S) : AKIHIKO KOBAYASHI

It is certified that error appears in the above-identified patent and that said Letters Patent is hereby corrected as shown below:

COLUMN 7

Line 33, "locating" should read --located--.
Line 58, "locating" should read --located--.
Line 59, "locating" should read --located--.

COLUMN 8

Line 14, "cating" should read --cated--.
Line 15, "locating" should read --located--.
Line 24, "prblems" should read --problems--.
Line 50, "cross sectional" should read --cross-sectional--.

COLUMN 9

Line 24, "serves an" should read --serves as an--.

COLUMN 12

Line 23, "is" should read --are--.

UNITED STATES PATENT AND TRADEMARK OFFICE

CERTIFICATE OF CORRECTION

PATENT NO. : 4,786,766

DATED : November 22, 1988

INVENTOR(S) : AKIHIKO KOBAYASHI

It is certified that error appears in the above-identified patent and that said Letters Patent is hereby corrected as shown below:

COLUMN 14

Line 12, "sandwiches" should read --sandwiched--.

Signed and Sealed this

Sixteenth Day of April, 1991

*Attest:*

*Attesting Officer*

HARRY F. MANBECK, JR.

*Commissioner of Patents and Trademarks*